US012104478B2

(12) United States Patent
Hassan et al.

(10) Patent No.: US 12,104,478 B2
(45) Date of Patent: Oct. 1, 2024

(54) METHOD AND SYSTEM FOR STIMULATING HYDROCARBON PRODUCTION

(71) Applicant: OCCIDENTAL OIL AND GAS CORPORATION, Houston, TX (US)

(72) Inventors: Khalil Hassan, Bakersfield, CA (US); Ahmed Al Kiyumi, Al Suwaiq (OM)

(73) Assignee: Occidental Oil and Gas Corporation, Houston, TX (US)

( * ) Notice: Subject to any disclaimer, the term of this patent is extended or adjusted under 35 U.S.C. 154(b) by 0 days.

(21) Appl. No.: 17/999,998

(22) PCT Filed: May 28, 2021

(86) PCT No.: PCT/US2021/034729

§ 371 (c)(1),
(2) Date: Nov. 28, 2022

(87) PCT Pub. No.: WO2021/243132

PCT Pub. Date: Dec. 2, 2021

(65) Prior Publication Data

US 2023/0296008 A1 Sep. 21, 2023

Related U.S. Application Data

(60) Provisional application No. 63/032,339, filed on May 29, 2020.

(51) Int. Cl.
*E21B 43/26* (2006.01)
*E21B 43/27* (2006.01)

(52) U.S. Cl.
CPC ..... *E21B 43/27* (2020.05)

(58) Field of Classification Search
CPC ..... E21B 43/26; E21B 43/27
See application file for complete search history.

(56) References Cited

U.S. PATENT DOCUMENTS

| | | | | |
|---|---|---|---|---|
| 6,047,773 | A * | 4/2000 | Zeltmann | E21B 34/063 166/387 |
| 9,187,977 | B2 * | 11/2015 | Alvarez | E21B 34/063 |
| 10,145,217 | B2 * | 12/2018 | Urbina | E21B 43/27 |
| 10,364,659 | B1 | 7/2019 | Tolman et al. | |
| 2008/0110622 | A1 | 5/2008 | Willett et al. | |
| 2012/0111566 | A1 | 5/2012 | Sherman et al. | |
| 2015/0041123 | A1 * | 2/2015 | Troshko | E21B 43/16 166/305.1 |
| 2016/0160625 | A1 * | 6/2016 | Maloney | G06Q 10/0635 166/308.1 |
| 2018/0216438 | A1 * | 8/2018 | Sewell | E21B 43/26 |

OTHER PUBLICATIONS

International Search Report and Written Opinion for corresponding PCT/US2021/034729 dated Jul. 28, 2021 (13 pp).

* cited by examiner

*Primary Examiner* — Matthew R Buck
(74) *Attorney, Agent, or Firm* — Kenner Renner; Arthur M. Reginelli

(57) ABSTRACT

A method for stimulating hydrocarbon production within an open-hole portion of a well, the method comprising ejecting a fluid from at least one perforated drill pipe into an open-hole portion of a well.

15 Claims, 4 Drawing Sheets

METHOD AND SYSTEM FOR STIMULATING HYDROCARBON PRODUCTION

This application is a National-Stage application of PCT/US2021/034729 filed on May 28, 2021, which claims the benefit of U.S. Provisional Application Ser. No. 63/032,339 filed on May 29, 2020, which are incorporated herein by reference.

FIELD OF THE INVENTION

Embodiments of the present invention provide a method and system for stimulating hydrocarbon production.

BACKGROUND OF THE INVENTION

Hydrocarbon production, which includes the extraction of liquid and gaseous hydrocarbons from geological formations in the earth, involves the drilling of wellbores into the subterranean and removal of hydrocarbons from the production zone or reservoir of the wellbore. In order to promote the migration of hydrocarbons toward the production zone of the well, stimulation techniques are often employed. This is particularly useful where hydrocarbons are not highly permeable through the geological formation. One common stimulation technique is hydraulic fracturing, which uses liquids to achieve pressures above the fracture gradient and thereby fracture the formation to provide pathways for hydrocarbons to migrate to the reservoir. Within horizontal wells, hydraulic fracturing typically involves cementing and casing the horizontal portion, such as by use of liners, perforating the casing, and then pumping fracturing fluids into the desired portions of the well through the perforations. This fracturing step requires isolation of the portion to be fractured, such as by way of packers. Multistage processes are often used whereby each isolated portion is sequentially fractured. Where the formation includes shale and/or limestone, proppants are typically introduced into the fractures to maintain the pathways created by the fracturing once the fracturing pressure is released. Where carbonate formations are fractured, it is common to introduce acid-containing fluids into the hydraulically-created fractures in order to etch and deepen the fracture.

The wellbores of carbonate formations can also be stimulated in open-hole portions of the well. For example, open-hole horizontal wellbores can be stimulated by acid-stimulation techniques that are referred to as "bullheading." According to these techniques, acid-containing fluids are pumped down a cased portion of the well toward an open-hole portion where the acid-containing fluid then contacts the geological formation. This contact typically is concentrated at the location where the cased well meets the open hole. Where the open hole is a horizontal deviation in the well, the acid first contacts the open hole at the heel of the horizontal lateral. Accordingly, challenges are faced where there is a desire to treat the geological formation further downstream of the heel.

In lieu of bullheading, jetting tools, which can be carried by coiled tubing, have been used to selectively administer the acid-containing fluid downstream of the heel. While useful, these techniques are hindered by the reach of the coiled tubing. Also, the efficiency of these methods is limited by the fact that the treatment is administered in stages along the length of the open hole. And, these techniques generally do not reach the fracture gradient and are therefore limited to matrix stimulation.

SUMMARY OF THE INVENTION

One or more embodiments of the present invention provide a method for stimulating hydrocarbon production within an open-hole portion of a well, the method comprising ejecting a fluid from at least one perforated drill pipe into an open-hole portion of a well.

Yet other embodiments of the present invention provide the method for hydrocarbon production, the method comprising (a) drilling a wellbore including a wellhead and horizontal portion; (b) casing a portion of the wellbore while providing for an open-hole portion in the horizontal portion of the wellbore; (c) pulling the drilling equipment form the wellbore; (d) running a drilling string in to the wellbore, where the drilling string includes a bottom hole assembly including a plurality of perforated pipes, each perforated drill pipe including at least one perforation, where said step of running positions the bottom hole assembly in the open hole portion of the wellbore, where said step of running forms an annulus between said drilling string and said open hole portion of the wellbore, said annulus being in fluid communication with an annular opening at the wellhead; (e) closing the annular opening at the wellhead; (f) pumping fluid down the drill string and into the bottom hole assembly to thereby cause fluid to eject from said perforations within the perforated drill pipes and thereby stimulate the wellbore; (g) pulling the drilling string including the bottom hole assembly; (h) running production equipment into the wellbore; and (i) producing hydrocarbons from the wellbore.

Other embodiments of the present invention provide a method for stimulating an open-hole wellbore within a carbonate formation, the method comprising (a) acid etching a plurality of locations within the open-hole portion of the wellbore; and (b) after said step of acid etching, fracturing the open-hole portion of the wellbore.

Still other embodiments of the present invention provide a system for stimulating a well, the system comprising (a) a vertical bore hole extending from the surface to a location within a subterranean location; (b) a lateral bore hole extending from said vertical bore hole; and (c) a drill string extending from the surface into said lateral bore hole, where said drill string includes a bottom hole assembly including at least one perforated pipe.

DETAILED DESCRIPTION OF ILLUSTRATIVE EMBODIMENTS

Figure 1:
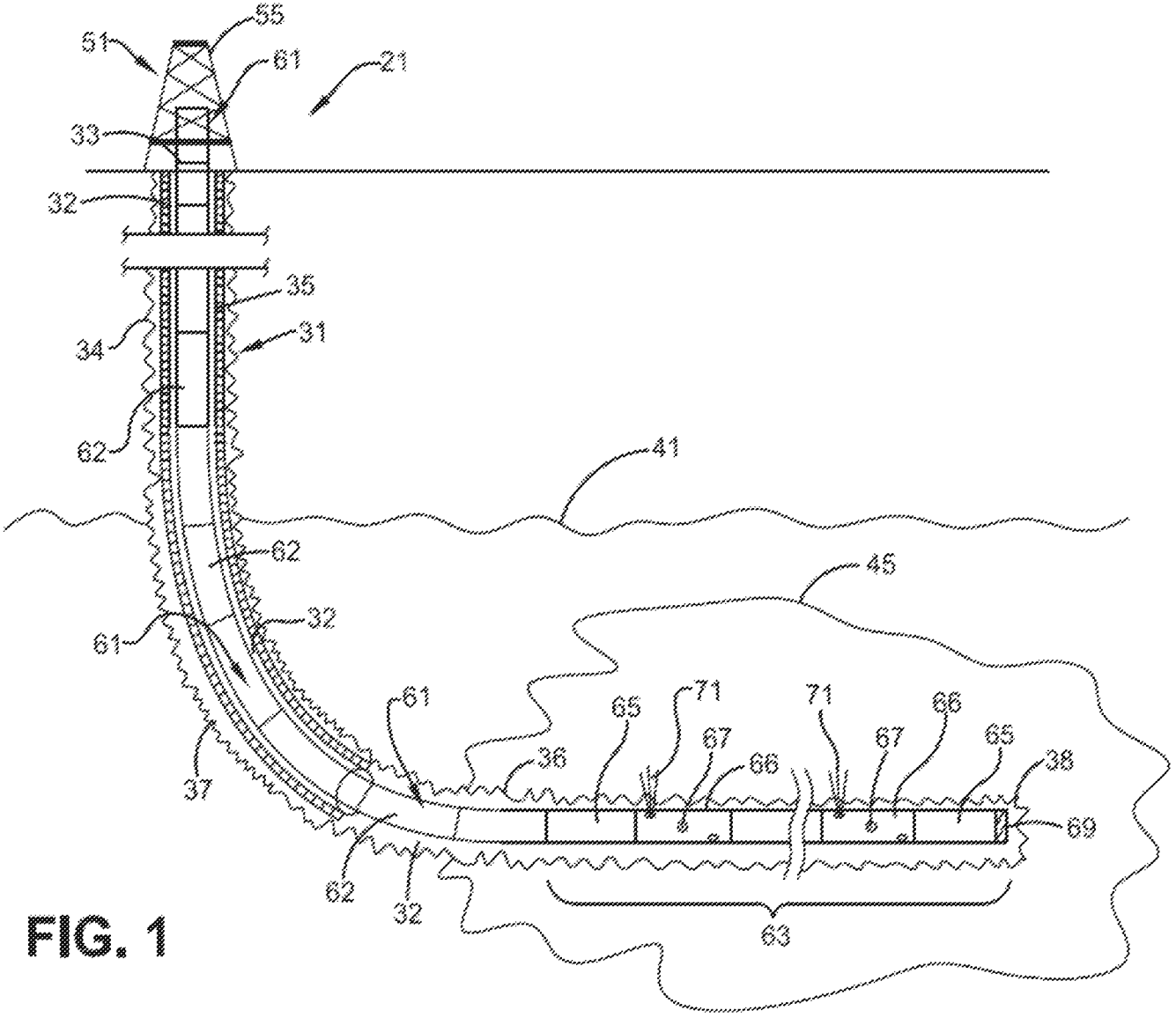
FIG. 1 is a schematic view of a hydrocarbon production system according to one or more embodiments of the present invention.

Embodiments of the invention are based, at least in part, on the discovery of a method and system for stimulating a geological formation (i.e. a hydrocarbon reservoir) for the extraction of hydrocarbons. According to embodiments of the invention, a modified bottom hole assembly is employed to inject a plurality of high-pressure liquid streams into an open-hole portion of a wellbore. Advantageously, the liquid streams can be simultaneously and/or evenly distributed across a large lateral section of the open wellbore optionally in combination with increasing the annular pressure of the wellbore. It is believed that this technique results in a unique fracture and etching pattern that provides efficient hydrocarbon production. For example, where the methods of the invention are practiced in a carbonate formation, it is believed that the resulting fracture and etching pattern is characterized by worm holing and microfractures. While jetting tools attached to coil tubing have been used to stimulate open-hole portions of wells, the jetting tools and associated methods cannot achieve analogous fracture and etching patterns since these methods cannot simultaneously and evenly treat large sections of an open hole, and they cannot achieve pressures above the fracture gradient.

System Overview

Embodiments of the invention can be described with reference to FIG. 1, which shows hydrocarbon stimulation system 21 within wellbore 31, which extends into geological formation 41. Wellbore 31 includes a terminus at wellhead 33 positioned at or near the earth's surface 43. Hydrocarbon stimulation system 21 includes a drilling rig 51, which is generally positioned over wellhead 33, and a drilling string 61 extending into wellbore 31. An annulus 32 exists between drilling string 61 and the inner diameter of wellbore 31 within the open-hole section 37 of wellbore 31.

Drilling rig 51 include a derrick or mast 55 that generally supports drill string 61, as well as mechanical assemblies (not shown) for raising and lowering drilling string 61 in and out of wellbore 31 (e.g. crown and traveling blocks), and for rotating drilling string 61 (e.g. a kelly). Those skilled in the art appreciate that drilling rig 51 may include numerous other components for effecting the drilling operation. For example, rig 51 may include one or more pumps (not shown) for pumping fluid down drilling string 61 or for applying pressure to annulus 32.

In one or more embodiments, geological formation 41 includes a carbonate formation. As those skilled in the art appreciate, this may include limestone and/or dolomite rock. In one or more embodiments, these formations may include those formations where greater than 80%, in other embodiments greater than 90%, and in other embodiments greater than 95% of the formation is a carbonate (e.g. calcium carbonate). According to embodiments of the present invention, geological formation 41 is capable of being degraded or otherwise impacted by interaction with acidic solutions. In other embodiments, other geological formations may be acted on by practice of the invention. For example, the geological formation may be a sandstone formation including those where the majority of the formation includes silica-containing compounds such as quartz. The skilled person appreciates that other formations may require the use of other types of fluids (e.g. slickwater frac may be used in sandstone formations). In one or more embodiments, geological formation 41 is in contact with or adjacent to a hydrocarbon formation 45, which may include liquid hydrocarbons (e.g. oil) and/or gaseous hydrocarbons (e.g. natural gas).

As shown, wellbore 31 includes a generally vertical portion 34 extending from wellhead 33 downward into the earth. Also, wellbore 31 includes a deviation 36, which may also be referred to as a horizontal portion 36 or lateral portion 36, extending from vertical portion 34. Those skilled in the art appreciate that wellbore 31 can include multiple deviated portions (not shown) extending from vertical portion 34 thereby forming a multi-lateral well. A transition 37, which may also be referred to as heel 37, connects vertical portion 34 to horizontal portion 36. In one or more embodiments, lateral 36 is located at a depth, as measured from the earth's surface, of greater than 10,000 feet, in other embodiments greater than 12,000 feet, and in other embodiments greater than 15,000 feet. In these or other embodiments, the length of horizontal portion 36, which extends from heel 37 to its terminus 38, is greater than 1000 feet, in other embodiments greater than 3000 feet, in other embodiments greater than 5000 feet, and in other embodiments greater than 7000 feet.

In one or more embodiments, at least a portion of vertical portion 34 includes a casing string 35. Conventional casing and casing techniques may be employed in practicing the present invention. As the skilled person understands, casing string 35 may include a plurality of pipes connected by coupling elements, and these pipes are typically cemented into the strata. Casing string 35 is typically employed to protect the wellbore and prevent fluids or other contaminants from migrating into the geographical strata surrounding the wellbore or vice versa, maintain wellbore stability, prevent contamination of water sands, isolate water from producing formations, and control well pressures during drilling, production, and workover operations. In addition to or in lieu of a casing, the casing string may include a liner.

According to embodiments of this invention, at least a portion of lateral portion 36 is devoid of casing. As the skilled person appreciates, these uncased portions of the well are referred to as open-hole portions. The skilled person also appreciates that annulus 32 is disposed between casing 35 and drilling string 61 where wellbore 31 is cased or between drilling string 61 and the inner diameter of wellbore 31 in an open-hole portion. In one or more embodiments, the length of the open-hole portion of the well is greater than 1000 feet, in other embodiments greater than 3000 feet, in other embodiments greater than 5000 feet, and in other embodiments greater than 7000 feet.

Drilling string 61 includes a plurality of connected drill pipes 62, which may be referred to individually as drill pipe joints 62 or simply joints 62, and a bottom hole assembly (BHA) 63. The skilled person understands that a drilling string is a dynamic system or assembly that is movable within the wellbore, is adapted to be rotated within the wellbore and pulled from the wellbore after drilling, and is adapted to deliver high-pressure fluids downhole. Drill pipes 62 employed in the practice of this invention may be conventional in nature and therefore include thin-walled hollow pipe connect by complementary male and female threaded ends. Generally, individual drill pipes 62 are about 20 to about 50 feet in length, with typical lengths being about 25 to about 35 feet. In one or more embodiments, drill pipes 62 have an outer diameter (OD) of from about 3 to about 6 inches, with typical lengths being from about 3.5 to about 4.5 inches. In these or other embodiments, drill pipes 62 have an inner diameter (ID) of from about 2.5 to about 5 inches, with typical lengths being from about 3 to about 3.8 inches. Drill pipes 62 have a wall thickness of from about 0.4 to about 1.0, and more typically from about 0.5 to about 0.8 inch. In conventional manner, drill pipe is fabricated from steel and steel alloys. Exemplary drill pipe includes, but is not limited to, API Grade drill pipe such as E-75, X-95, G-105, and S-135 drill pipe.

In one or more embodiments, BHA 63 includes a series of connected pipe, which includes at least one perforated pipe, and a terminal end 69, which may also be referred to as a bullnose 69. Terminal end 69 may include a plug or cap and optionally one or more safety valves, which provide bullnose 69 with the ability to maintain pressures introduced into drill sting 61. The length of BHA 63 may therefore be defined from the upstream-most perforated pipe (i.e. the perforated pipe closest to the surface) to the terminal end or bullnose 69. In one or more embodiments, as shown in FIG. 1, BHA 63 includes interconnected non-perforated drill pipe 65 and perforated drill pipe 66. Non-perforated drill pipe 65 and perforated drill pipe 66 may be interconnected using conventional features and/or techniques such as alternating male and female threaded ends.

In one or more embodiments, non-perforated drill pipe 65, which may also be referred to as blank pipe 65, may be of the type of drill pipe employed in other areas of drill sting string 61 as described above (e.g. may be the same or similar to drill pipe 62). In other embodiments, drill pipe 65 may be of a different type. For example, drill pipe 65 may have a thinner wall thickness, or in other embodiments a thicker wall thickness, than drill pipe 62. Or, in other embodiments, drill pipe 65 may be fabricated of a different material, such as a different steel alloy, than drill pipe 62.

As indicated above, BHA 63 includes at least one perforated pipe 66, which may be referred to as BHA perforated pipe 66 or perforated joint 66, which includes a plurality of perforations 67, which may also be referred to as perforated holes 67, jetting holes 67, or simply holes 67. In one or more embodiments, perforated pipe 66 includes from about 1 to about 10, in other embodiments from about 1 to about 5, in other embodiments from about 2 to about 4 holes, and in one or more embodiments 3 holes per pipe length (i.e. per joint).

Figure 2A:
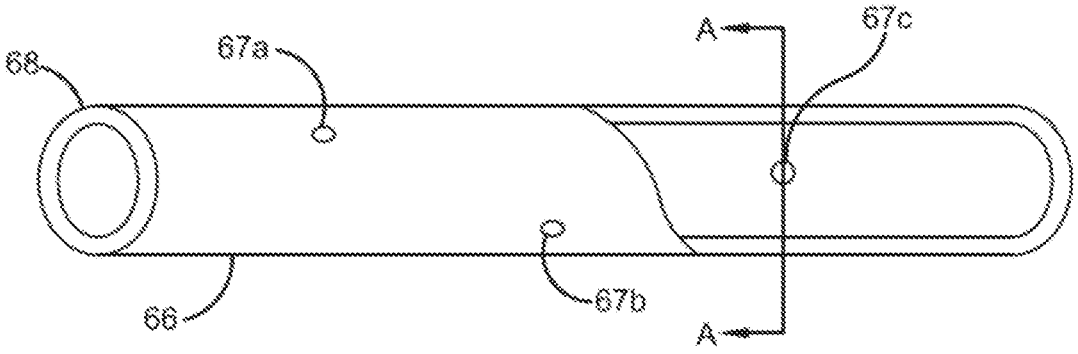
FIG. 2A is a schematic view of a perforated drill pipe joint according to aspects of the present invention.
Figure 2B:
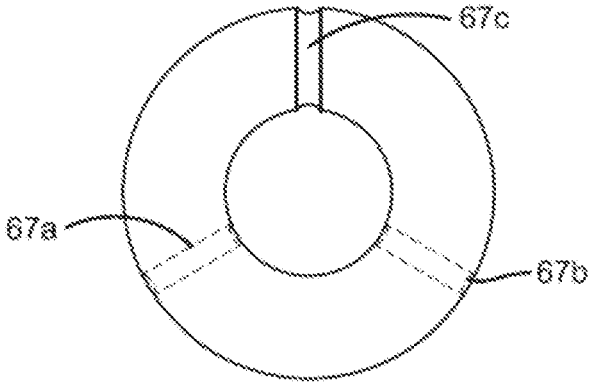
FIG. 2B is a cross-sectional view taken along line A-A.

With reference to FIG. 2A, perforated joint 66 is shown and includes holes 67*a*, 67*b*, and 67*c*. As best shown in FIG. 2B, holes 67*a*, 67*b*, and 67*c* are spaced, relative to the circumference 68 of perforated pipe 66, about 120 degrees apart. Other configurations can also be designed including embodiments were the plurality of holes are randomly disposed around the circumference of the pipe, or where the holes are aligned relative to each other relative to the circumference of the pipe.

In one or more embodiments, holes 67 (e.g. holes 67*a*, 67*b*, and 67*c* as shown in FIG. 2A) can generally be evenly spaced relative to the axial length of the pipe. In one or more embodiments, one hole is disposed in the center of the pipe relative to the axial length 67*b*, and the other holes can be evenly spaced, such as about 5 feet from the center hole (i.e. 67*a* and 67*c* are each spaced 5 feet from 67*b*). In other embodiments, other spacing patterns can be adopted. In one more embodiments, the respective holes on any given perforated pipe are spaced, relative to the axial length, at a distance of greater than 2 feet, in other embodiments greater than 4 feet, in other embodiments greater than 5 feet, and in other embodiments greater than 6 feet.

As with drill pipes 62, and blank 65, the individual perforated pipes 66 include thin-walled hollow pipe connected to adjacent pipe by complementary male and female threaded ends. In other words, perforated pipes 66 may include a drill pipe having holes 67 fabricated (e.g. drilled) into the pipe. Accordingly, perforated pipe 66, but for the perforations, may be of the same or similar type of pipe employed in the other areas of drill string 61 including drill pipe 62 and blank pipe 65.

Generally, in one or more embodiments, individual BHA perforated pipes 66 are about 20 to about 50 feet in length, with typical length being about 25 to about 35 feet. In one or more embodiments, BHA perforated pipes 66 have an outer diameter (OD) of from about 3 to about 6 inches, with typical diameters being from about 3.5 to about 4.5 inches. In these or other embodiments, BHA perforated pipes 66 have an inner diameter (ID) of from about 2.5 to about 5 inches, with typical diameters being from about 3 to about 3.8 inches. In one or more embodiments, BHA perforated pipes 66 may have a wall thickness of from about 0.4 to about 1.0, and more typically from about 0.5 to about 0.8 inch.

In one or more embodiments, holes 67 have a diameter of from about 1 to about 10 mm, in other embodiments from about 1.3 to about 7 mm, in other embodiments from about 1.5 to about 5 mm, and in other embodiments from about 2 to about 4 mm. In one or more embodiments, holes 67 are positioned in a pattern around the circumference of perforated pipe 66. For example, holes 67 can be disposed in a spiral pattern along the length of perforated pipe 66.

In one or more embodiments, BHA 63 has a length (as measured from the first perforated pipe to the terminal end or bullnose) that can vary and is only limited by the length that can be drilled. As a result, practice of the present invention is advantageous since the BHA's length is only limited by the length of the drilling used to create the wellbore. In one or more exemplary embodiments, the BHA has a length of greater than 1000 feet, in other embodiments greater than 3000 feet, and in other embodiments greater than 5000 feet. In these or other embodiments, BHA 63 has a length of less than 15,000 feet, in other embodiments less than 12,000 feet, in other embodiments less than 10,000 feet, and in other embodiments less than 8000 feet. In one or more embodiments, BHA 63 has a length of from about 1000 to about 12,000 feet, in other embodiments from about 3000 to about 10,000 feet, and in other embodiments from about 5000 to about 8000 feet.

Figure 3:
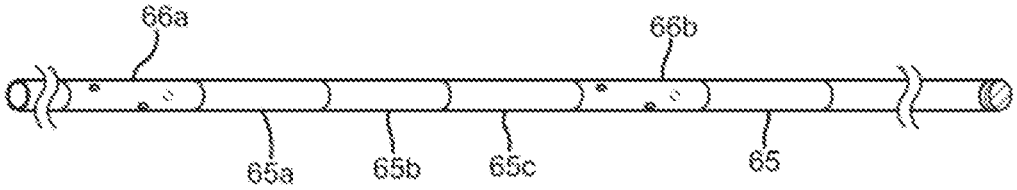
FIG. 3 is a schematic view of a portion of a bottom hole assembly according to one or more embodiments of the present invention.
Figure 4:
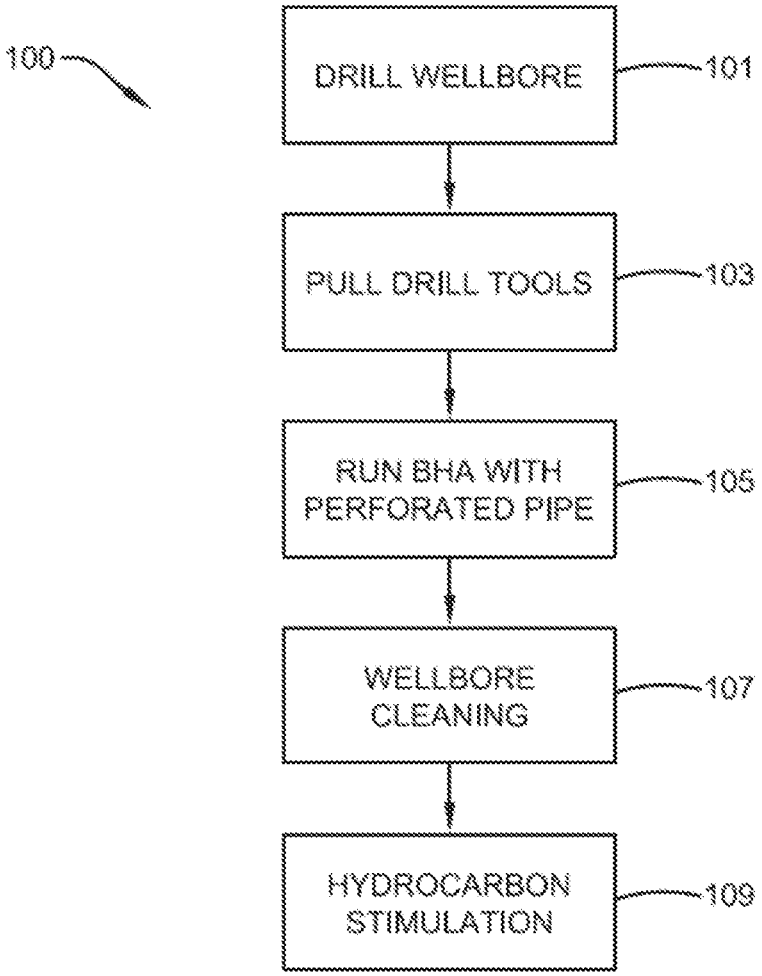
FIG. 4 is a flow chart describing one or more methods according to the present invention.

As generally shown in FIG. 1, BHA 63 includes perforated pipe 66 and non-perforated pipe 65, which may also be referred to as blank pipe. In one more embodiments, perforated pipe 66 is staggered between one or more non-perforated pipe 65. In one or more embodiments, greater 2, and in other embodiments greater than 3 non-perforated pipes 65 are disposed between perforated pipe 66. In one or more embodiments, from about 1 to about 5, in other embodiments from about 2 to about 5, and in other embodiments 3 non-perforated pipes 65 are disposed between perforated pipes 66. As best shown in FIG. 3, three non-perforated pipe 65*a*, 65*b*, and 65*c* are disposed between perforated pipes 66*a*, 66*b*. In one or more embodiments, this series or pattern can continue substantially constant along the length of BHA 63. Alternatively, the pattern can vary along the length of BHA 63. In one or more embodiments, BHA 63 includes from about 60 to about 120, or in other embodiments from about 80 to about 100 feet of non-perforated pipe 65 between perforated pipes 66.

In one or more embodiments, BHA 63 includes greater than 1, in other embodiments greater than 6, in other embodiments greater than 12, in other embodiments greater than 18, and in other embodiments greater than 24 perforated pipes (i.e. perforated joints 66). In these or other embodiments, BHA 63 includes less than 100, in other embodiments less than 75, and in other embodiments less than 50 perforated pipes. In one or more embodiments, BHA 63 includes from about 12 to about 100, in other embodiments from about 18 to about 75, and in other embodiment from about 18 to about 50 perforated pipes. In one or more embodiments, the number of holes 67 within the entirety of BHA 63 can be quantified. In one or more embodiments, BHA 63 includes from about 50 to about 150, or in other embodiments from 75 to about 105 jetting holes, or other embodiments from about 85 to about 95 jetting holes distributed over a plurality of joints within the BHA (which as described above includes both perforated and non-perforated joints). In these or other embodiments, BHA 63 includes greater than 1, in other embodiments greater than 2, and in other embodiments greater than 3 holes per 120 lineal feet.

Operation of System

As indicated above, the stimulation system of the present invention can be used to stimulate hydrocarbon production from a geological formation (e.g. carbonate formation). In one or more embodiments, this is accomplished by pumping fluid down drill string 61 under sufficient conditions to cause the fluid to radially eject from pipe 66 through holes 67 into geological formation 41. According to aspects of the present invention, the ejection of fluid from holes 67 forms high-velocity fluid streams 71 that are believed to mechanically etch or cut geological formation 41. Additionally, where fluid stream 71 includes acidic constituents, it is believed that fluid stream 71 chemically etches or otherwise erodes channels, which may be referred to as worm holes, into geological formation 41. Advantageously, the system of the present invention is configured to maintain substantially constant fluid velocity from each of the plurality of holes 67. In one or more embodiments, the fluid velocity from each hole (which is analogous to the pressure drop through each hole) within BHA 63 deviates by no more than 15%, in other embodiments by no more than 10%, and in other embodiments by no more than 5% relative to each hole in the plurality. Where the annulus between the bottom hole assembly and the bore hole (i.e. annulus 32 between BHA 63 and bore hole 36 as shown FIG. 1) is closed or otherwise pressurized at the wellhead (e.g. wellhead 33), the process of the present invention also pressurizes the annulus, which in combination with the number of mechanical and chemical etched channels, is believed to create a unique fracture pattern, characterized by micro-fractures, within the formation.

In one or more embodiments, the system of the present invention can be employed in the construction of a new well or a portion of a well. For example, and with reference to FIG. 2, the process includes a first step of drilling a wellbore 101, which may be accomplished by using conventional drilling techniques. In other embodiments, a portion of a wellbore is drilled, such as a new lateral from an existing vertical wellbore. Drilling step 101 is following by a step of pulling the drilling equipment (e.g. drilling string) from the wellbore 103. Once the drilling equipment is removed from the wellbore, the process includes running a drilling string with a modified BHA (i.e. including perforated pipe) according the present invention into the wellbore (or desired location of a wellbore) 105.

In one or more embodiments, an optional step of bore cleaning 107 may take place by injecting a fluid, under a desired pressure, down the drilling string to produce radially directed fluid streams from the perforations in the perforated pipe of the BHA. In one or more embodiments, the BHA is optionally rotated 360 degrees and/or optionally moved axially within the bore hole while the fluid is being ejected radially from the perforated pipe. As a result, various materials within the wellbore, which may be disposed within the annulus between the BHA and the inner diameter of the wellbore (which is an open hole portion of the well bore), such as mud filter cake and drilling residues, can be removed from the wellbore as the excess fluid rises in the fluid annulus (e.g. within annulus 32). Accordingly, during the step of cleaning, the wellhead is adjusted to allow fluids and other materials to flow out of the well through the annulus. As those skilled in the art will appreciate, this fluid, together with the materials that it carries, can be directed to an appropriate location via appropriate piping.

In one or more embodiments, the fluid injected during bore cleaning step 107 includes brine. The brine may be of sufficient weight to overbalance formation pressure. In one or more embodiments, fluids ejected from the perforated pipe during bore cleaning step 107 are injected into the drill string under a pressure (which may be referred to as pumping pressure, tubing pressure, or injection pressure) of greater than 8000 psi, in other embodiments greater than 9000 psi, and in other embodiments greater than 10,000 psi as measured at the well head. In these or other embodiments, from about 100 to about 500, or in other embodiments from about 200 to about 400 barrels of brine are pumped down the drilling string at a rate of from about 15 to about 45, or in other embodiments from about 20 to about 30 barrels per minute during the cleaning operation.

Following optional cleaning step 107, hydrocarbon stimulation 109 takes place by injecting fluid at a desired rate through the drilling string to produce radially directed fluid streams designed to mechanically etch, cut or otherwise impact the surrounding geological formation. In one or more embodiments, the annulus is closed or otherwise pressurized to thereby produce a pressure increase within the annulus. For example, fluid, such as brine, may be pumped down the annulus (e.g. annulus 32) while fluids are pumped down the drilling string.

In one or more embodiments, during stimulation step 109, the BHA is fixed in position relative to the open hole. In other embodiments, BHA may be optionally rotated 360 degrees and/or optionally moved axially within the bore hole while the fluid is being ejected radially from the perforated pipe.

In one or more embodiments, the fluid ejected from the perforated pipe during stimulation step 109 contains a mineral acid such as, but not limited to, hydrochloric acid. The hydrochloric acid may be carried by a variety of fluid carriers including organic and aqueous mediums. For example, aqueous acidic solutions can be used. In combination therewith or in lieu thereof, acidic emulsifications (where the acid species are emulsified or otherwise phase-dispersed from the organic species) can also be used. In particular embodiments, acid emulsions in diesel are employed. In one or more embodiments, the mineral acid is present at from about 10 to about 30 wt % within the fluid. In one or more embodiments, fluids may pumped in intervals during the stimulation step. For example, brine can be pumped in a first interval, followed by one or more intervals where acidic-bearing fluids are pumped, followed by a final interval where brine is again pumped. The one or more intervals where acidic-bearing fluids are pumped may include the use of varying types of acidic-bearing fluids. For example, a first acidic-bearing fluid, such as an acidic solution, can be pumped in a first interval, followed by pumping a second acidic-bearing fluid, which may include an acidic emulsion, in a second interval.

In one or more embodiments, fluids ejected from the perforated pipe during bore stimulation step 109 are injected into the drill string under a pressure (which may be referred to as pumping pressure, tubing pressure, or injection pressure) of greater than 8000 psi, in other embodiments greater than 9000 psi, and in other embodiments greater than 10,000 psi as measured at the well head. In these or other embodiments, from about 1800 to about 3500, or in other embodiments from about 2000 to about 2500 barrels of acidic-bearing fluid are pumped down the drilling string at a rate of from about 25 to about 45, or in other embodiments from about 30 to about 40 barrels per minute during the stimulation operation. In one or more embodiments, the injection pressure is at least sufficient to surpass the critical flow threshold, which permits fluid to be ejected from each of the perforations at a relatively constant velocity.

In conjunction pumping fluids into the drill string during stimulation step 109, for example simultaneous therewith, fluids can be injected into the annulus. Depending on the nature of the geological formation, the pumping of fluids into the annulus can create a pressure (i.e. annular pressure) of greater than 100 psi, in other embodiments greater than 500 psi, in other embodiments greater than 1000 psi, in other embodiments greater than 2000 psi, in other embodiments greater than 3000 psi, and in other embodiments greater than 4000 psi as measured at the well head. In these or other embodiments, during the stimulation step, fluid, such as brine, can be pumped down into the wellbore through the annulus at a rate of from about 1 to about 10, or in other embodiments from about 1 to about 5, and in other embodiments from about 2 to about 5 barrels per minute during the stimulation operation. The total barrels pumped down the annulus during said step of stimulating may vary depending on several factors including, but not limited to, the duration of the stimulation step, the amount of fluid pumped down the drill string, and the nature of the formation. In one or more embodiments, the stimulation step (i.e. the ejection of fluids from the perforated drill pipe into the open-hole formation), optionally together with pressurizing the annulus through, for example, injecting fluid down the annulus from the wellhead, takes place at appropriate parameters (such as duration, pressure, and fluid volume) to achieve a pressure within the annuls that is greater than 80% of the fracture gradient of the formation, in other embodiments greater than 90% of the fracture gradient of the formation, in other embodiments greater than 100% of the fracture gradient of the formation, and in other embodiments greater than 110% of the fracture gradient of the formation. The skilled person will appreciate that depending on the nature of the geological formation, the application of pressure into the annulus (through the perforated pipe and through downhole annular pressure) can cause the geological formation to fracture when pressures in excess of the fracture gradient are achieved.

In one or more embodiments, the well is maintained under the conditions stated above for at least 10 minutes, in other embodiments at least 20 minutes, and in other embodiments at least 30 minutes.

It should be appreciated that one of the benefits of the practice of the present invention is the ability to treat (e.g. etch and/or fracture) multiple locations within an extended lateral section of a wellbore. As generally described above, greater than 1000 feet (e.g. greater than 3000 and 5000 feet) of lateral section can be treated at greater than 50 distinct locations (e.g. greater than 75 or 85 locations) simultaneously. It should also be appreciated that the techniques of this invention allow for a combination of three distinct effects including wellbore cleaning, etching (e.g. worm holing), and fracturing.

Following the stimulation process, the stimulation system (e.g. BHA 63) is pulled from the well using conventional pulling equipment and techniques. Once the stimulation equipment is pulled from the well, hydrocarbon production can take place by running conventional production equipment.

Design Specifications

In one or more embodiments, the stimulation system, as well as the parameters under which stimulation takes place, is configured to achieve a desired pressure drop through the perforations, which in turn yields a desired velocity of high-velocity fluid stream 71 into geological formation 41, as well as the desired pressure achieved within the annulus of the borehole. In one or more embodiments, the system and operational parameters are configured to achieve a pressure drop through the perforations of greater than 1000 psi, in other embodiments greater than 1200 psi, in other embodiments greater than 1300 psi, in other embodiments greater than 1500 psi, in other embodiments greater than 1800 psi, in other embodiments greater than 2000 psi, in other embodiments greater than 2500 psi, in other embodiments greater than 3000 psi, in other embodiments greater than 4000 psi. In one or more embodiments, the system and operational parameters are configured to achieve a pressure drop of from about 1300 to about 6000 psi, in other embodiments from about 1500 to about 5000 psi, and in other embodiments from about 1500 to about 2500 psi. In fact, it is believed that as pumping technology improves, those skilled in the art will be able to design systems and configurations that can achieve even higher pressure drop through the perforations.

The skilled person understands that several design and operational parameters can be altered to achieve the desired pressure drop across the perforations including, but not limited to, the size (e.g. length) and number of perforations in the string, the inner diameter of the pipes, the pressure exerted on the fluid within the pipe string, and the pressure of the annulus. The skilled person also understands that these relationships follow established scientific principles related to choked flow, which is associated with the venturi effect and which can be mathematically represented by the Bernoulli Equation:

$$p_1 - p_2 = \frac{\rho}{2}(v_2^2 - v_1^2)$$

where $\rho$ is the density of the fluid, $v_1$ is the slower fluid velocity where the pipe if wider, $v_2$ is the faster fluid velocity where the pipe is narrower. By using these equations, one skilled in the art can calculate the required design specifications to achieve the desired velocity of high-pressure of the fluid streams.

Various modifications and alterations that do not depart from the scope and spirit of this invention will become apparent to those skilled in the art. This invention is not to be duly limited to the illustrative embodiments set forth herein.

What is claimed is:

1. A method for stimulating hydrocarbon production within an open-hole portion of a well within a formation, the method comprising:

(a) providing a drill string extending from a well head to the open-hole portion of the well, said drill string including a drill pipe having multiple perforations, said drill pipe having multiple perforations being positioned within the open-hole portion of the well, said drill string forming an annulus between the drill string and an inner wall of the well;

(b) pumping a first fluid down the drill string to thereby radially eject the fluid from the multiple perforations within the drill pipe having multiple perforations; and (c) pumping a second fluid down the annulus from the well head, whereby said steps of pumping a first fluid down the drill string and pumping a second fluid down the annulus achieves a pressure within the annulus that is greater than 80% of the fracture gradient of the formation.

2. The method for stimulating of claim 1, where the first fluid includes acidic constituents.

3. The method for stimulating of claim 1, where the open-hole portion of the well is within a carbonate geological formation.

4. The method for stimulating of claim 1, where said step of pumping a first fluid down the drill string causes a pressure drop through said perforations of greater than 1000 psi.

5. The method for stimulating of claim 1, where the open-hole portion of the well has a length of greater than 1000 feet, where said drill pipe having multiple perforations has a length of from about 20 to 50 feet and at least 6 perforated drill pipes.

6. The method for stimulating of claim 1, where said drill pipe having multiple perforations is included within a bottom hole assembly, and where the bottom hole assembly includes from about 12 to about 100 pipes having multiple perforations.

7. The method for stimulating of claim 1, where said steps of pumping a first fluid down the drill string and pumping a second fluid down the annulus creates a pressure within the annulus of greater than 100 psi.

8. The method for stimulating of claim 1, where said steps of pumping a first fluid down the drill string and pumping a second fluid down the annulus creates a pressure within the annulus of greater than 1000 psi.

9. The method for stimulating of claim 1, where said second fluid is a brine.

10. The method for stimulating of claim 1, where said steps of pumping a first fluid down the drill string and pumping a second fluid down the annulus creates a pressure within the annulus that is greater than the fracture gradient of the formation.

11. A method for hydrocarbon production, the method comprising:

(a) drilling with the use of drilling equipment, a wellbore including a wellhead and horizontal portion;

(b) casing a portion of the wellbore while providing for an open-hole portion in the horizontal portion of the wellbore;

(c) pulling the drilling equipment from the wellbore;

(d) running a drilling string in to the wellbore, where the drilling string includes a bottom hole assembly including a plurality of perforated pipes, each perforated pipe including at least one perforation, where said step of running positions the bottom hole assembly in the open hole portion of the wellbore, where said step of running forms an annulus between said drilling string and said open hole portion of the wellbore, said annulus being in fluid communication with an annular opening at the wellhead;

(e) closing the annular opening at the wellhead;

(f) pumping fluid down the drill string and into the bottom hole assembly to thereby cause fluid to eject from said perforations within the perforated drill pipes and thereby stimulate the wellbore;

(g) pulling the drilling string including the bottom hole assembly;

(h) running production equipment into the wellbore; and (i) producing hydrocarbons from the wellbore.

12. The method for hydrocarbon production of claim 11, where the fluid is ejected from said perforations under a pressure drop of greater than 1000 psi.

13. The method for hydrocarbon production of claim 11, where pressure within the annulus during said step of pumping fluid down the drill string is greater than 2000 psi.

14. The method for hydrocarbon production of claim 11, further including the step of cleaning the open-hole portion of the wellbore prior to said step of closing the annular opening at the wellhead, where said step of cleaning includes pumping fluid down the drill string and into the bottom hole assembly to thereby cause fluid to eject from said perforations within the perforated drill pipes and thereby clean the open-hole portion of the wellbore.

15. The method for hydrocarbon production of claim 14, further including the step of rotating and reciprocating the bottom hole assembly during said step of cleaning.

* * * * *